US005915288A

United States Patent [19]

Gabriel

[11] Patent Number: 5,915,288

[45] Date of Patent: Jun. 22, 1999

[54] INTERACTIVE SYSTEM FOR SYNCHRONIZING AND SIMULTANEOUSLY PLAYING PREDEFINED MUSICAL SEQUENCES

[75] Inventor: Joshua Gabriel, San Francisco, Calif.

[73] Assignee: Interactive Music Corp., San Francisco, Calif.

[21] Appl. No.: 09/026,232

[22] Filed: Feb. 19, 1998

Related U.S. Application Data

[63] Continuation of application No. 08/592,107, Jan. 26, 1996, Pat. No. 5,824,933.

[51] Int. Cl.[6] ..... A63H 5/00; G04B 13/00; G10H 7/00

[52] U.S. Cl. ..... 84/609; 84/649; 84/743

[58] Field of Search ..... 84/600, 601, 609, 84/613, 649, 650, 743, 745

[56] References Cited

U.S. PATENT DOCUMENTS 5,153,829 10/1992 Furuya et al. .
5,286,908 2/1994 Jungleib ..... 84/609 X
5,331,111 7/1994 O'Connell .
5,355,762 10/1994 Tabata ..... 84/609
5,391,828 2/1995 Tajima ..... 84/610 X

*Primary Examiner*—Jeffrey W. Donels
*Attorney, Agent, or Firm*—David G. Alexander

[57] ABSTRACT

A plurality of pre-recorded, generated or other sound tracks (e.g. voice, karaoke) are selectable and de-selectable by a user for synchronously mixing with a main song track and all other sound tracks that are playing. The sound tracks are matched and synchronized to the song track. A visual display depicts icons which represent the sound tracks, and indicate which sound tracks are selected and de-selected. The user creates an individual musical performance by interactively selecting and de-selecting one or more sound tracks using a joystick or keyboard on a real-time basis with instantaneous visual and audible feedback. Depending on the musical content of each sound track, various operational modes ensure that whenever a track is selected, the result is always immediate, musically synchronized and aesthetically pleasing.

10 Claims, 10 Drawing Sheets

INTERACTIVE SYSTEM FOR SYNCHRONIZING AND SIMULTANEOUSLY PLAYING PREDEFINED MUSICAL SEQUENCES

This application is a continuation of U.S. patent application Ser. No. 08/592,107, entitled INTERACTIVE SYSTEM FOR SYNCHRONIZING AND SIMULTANEOUSLY PLAYING PREDEFINED MUSICAL SEQUENCES, filed Jan. 26, 1996 by Joshua Gabriel, now U.S. Pat. No. 5,824, 933, issued Oct. 20, 1998.

BACKGROUND OF THE INVENTION

1. Field of the Invention

The present invention generally relates to the art of electronic musical performance, and more specifically to an interactive system for synchronizing and simultaneously playing predefined musical sequences or tracks.

2. Description of the Related Art

Recorded music is traditionally packaged in the form of cassette tapes or compact discs (CDs) for playing on dedicated machines. The original performing and recording artists determine every aspect of the creation and presentation of the music, and users merely listen passively to the recordings.

For persons who wish to create and/or perform music themselves rather than just passively listening, several alternatives are currently available.

1. Physical performance by voice and traditional musical instruments.

2. Singing along with pre-recorded background sound tracks (karaoke).

3. Electronically creating and/or modifying music using a synthesizer.

4. Serially playing musical sequences or "snippets" using a computer and appropriate software.

The first option of actually creating and performing music requires musical training, as well as considerable time and practice. In addition, the music must be physically performed every time it is to be enjoyed.

A karaoke machine allows a user to select a musical background track from a plurality of prerecorded tracks, and sing along with the selected track as it is played. The user's vocal presentation is amplified and superimposed on the background track, which is usually an instrument-only version of the song.

Karaoke systems attempt to synchronize the music and the song by displaying the lyrics on a television screen as the background track plays. However, if the singer is not skilled, the performance can be unpleasantly out of synchronization with the background track.

Although the capabilities and complexities of electronic keyboards and synthesizers vary, they basically play an underlying rhythm onto which the user may superimpose additional notes via an input device which is typically a keyboard. These devices generally provide underlying rhythmic beats, and not complete sound tracks for songs. The requirement of additional musical input and the limitation as to what the devices are able to provide limits the usefulness of these devices to persons with musical ability and training.

With the proliferation of computers capable of processing multi-media data, some computer software systems allow a user to selectively play one or more sequences of prerecorded music. However, in these systems, each of the sequences is typically a short snippet from a larger musical score, and the system merely allows the user to serially arrange the order in which the snippets are played.

Computer systems further enable additional sounds which the user may select to be superimposed. However, the superimposed sounds, which also are snippets, are not synchronized to the serially arranged snippets being played. The users of such systems are typically limited to those with sufficient computer knowledge and experience to use the computer interfaces to create an aesthetic musical arrangement.

SUMMARY OF THE INVENTION

In contrast to the prior art systems described above, the present invention provides an interactive musical experience which can be enjoyed even by persons with no musical training or skill.

In accordance with the present invention, a plurality of pre-recorded, generated or other sound tracks (e.g. voice, karaoke) are selectable and de-selectable by a user for synchronously mixing with a main song track and all other sound tracks that are playing.

A visual display depicts icons which represent the sound tracks, and indicate which sound tracks are selected and de-selected. The user creates an individual musical performance by interactively selecting and de-selecting one or more sound tracks using a joystick or keyboard on a real-time basis, with instantaneous audible and visual feedback.

Depending on the musical content of each sound track, an operational mode such as harmonic follow is preset to eliminate undesirable effects such as double triggering, and provide an aesthetic entrance for the sound track upon selection.

The present invention enables a user to create and present new variations and mixes of songs by custom mixing musical tracks or sound sequences.

These and other features and advantages of the present invention will be apparent to those skilled in the art from the following detailed description, taken together with the accompanying drawings, in which like reference numerals refer to like parts.

DETAILED DESCRIPTION OF THE INVENTION

A system of the present invention enables a user to play a main song track, and interactively add or mix one or more of a plurality of associated sound tracks with the main track on a real-time basis. Instantaneous audio and visual feedback of selected and de-selected sound tracks give the user a feeling of becoming "at one" with the system, and enable him or her to create an unlimited variety of individual musical performances.

A system of the invention, named the "Mixman", is a product of Interactive Music Corp. of San Francisco, Calif.

As will be described in detail below, the present system generally includes a display unit such as a computer monitor having visual icons corresponding to the sound tracks, and an input unit such as a computer keyboard for selecting and de-selecting sound tracks. The system further includes a player such as a multi-media computer for playing the selected tracks.

In one form of the invention, the entire system can be embodied by a general purpose multi-media personal computer which is programmed by software provided on a floppy disk, CD-ROM or the like to provide the required functionality.

In another form of the invention, a conventional or specially designed joystick may replace the computer keyboard as the input device. The joystick can also be provided with lights or the like which constitute the icons, whereby the joystick constitutes both the input and display units.

Rather than a general purpose computer, the player may be a dedicated hardware device which is combined with a suitable display unit and input unit. The hardware device may be hardwired to provide the system functionality, or may operate under control of software provided on a floppy disk, CD-ROM or the like. The software alternative enables the system to be easily modified or upgraded as required.

It is further within the scope of the invention to integrate any two or all three of the player, display unit and input unit in any combination as a dedicated device.

Figure 1:
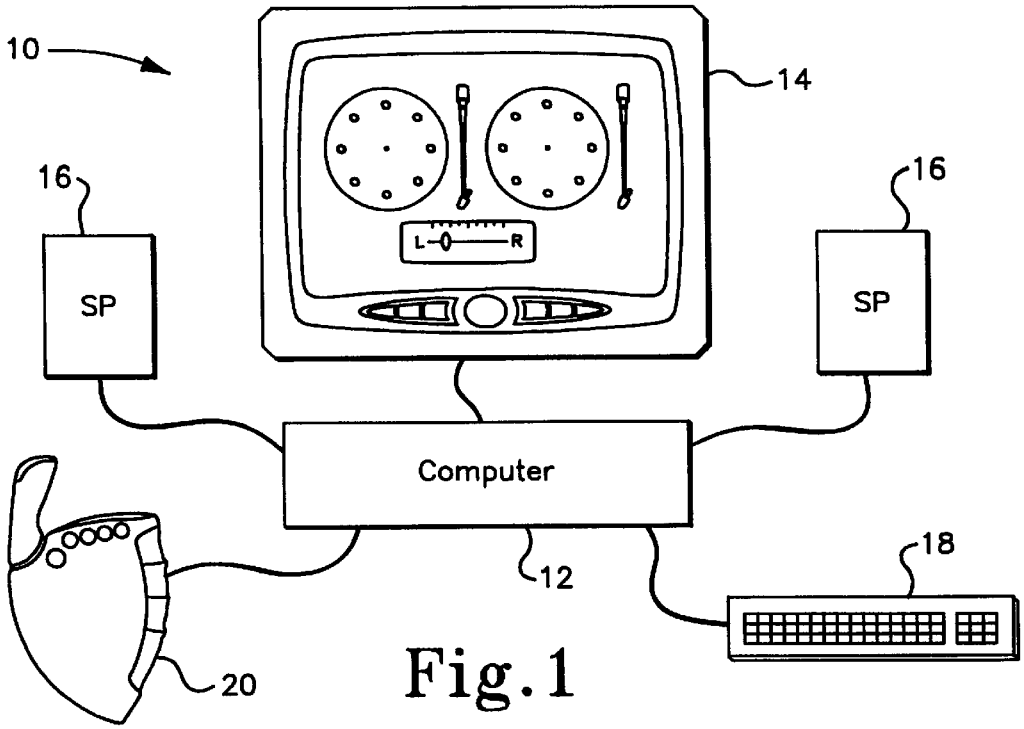
FIG. 1 is a diagram illustrating the major components of an interactive system for synchronizing and simultaneously playing predefined musical sequences or tracks according to the present invention.

FIG. 1 illustrates a preferred embodiment of the present invention in which the functions of the player and display unit are provided by a general purpose multi-media personal computer, and the input unit is a specially designed joystick.

As shown in FIG. 1, a system 10 for playing predefined musical sequences in accordance with the present invention includes a player which is constituted by a general purpose multi-media personal computer 12, and a display unit which is constituted by a display monitor 14 of the computer 12.

The functionality of the system 10 is implemented by a software program which is provided on a floppy disk, CD_ROM or the like, and is loaded into and run by the computer 12. The software can also be downloaded from the internet or other source. The system 10 produces musical sounds via stereo speakers 16 which are connected to the computer 12.

A user may utilize a keyboard 18 of the computer 12 as an input unit for selecting and de-selecting musical tracks or sequences. Another preferred input unit is a specially designed joystick 20 as will be described in detail below. The keyboard 18 and joystick 20 constitute actuator devices for manually inputting user commands into the system.

Figure 2:
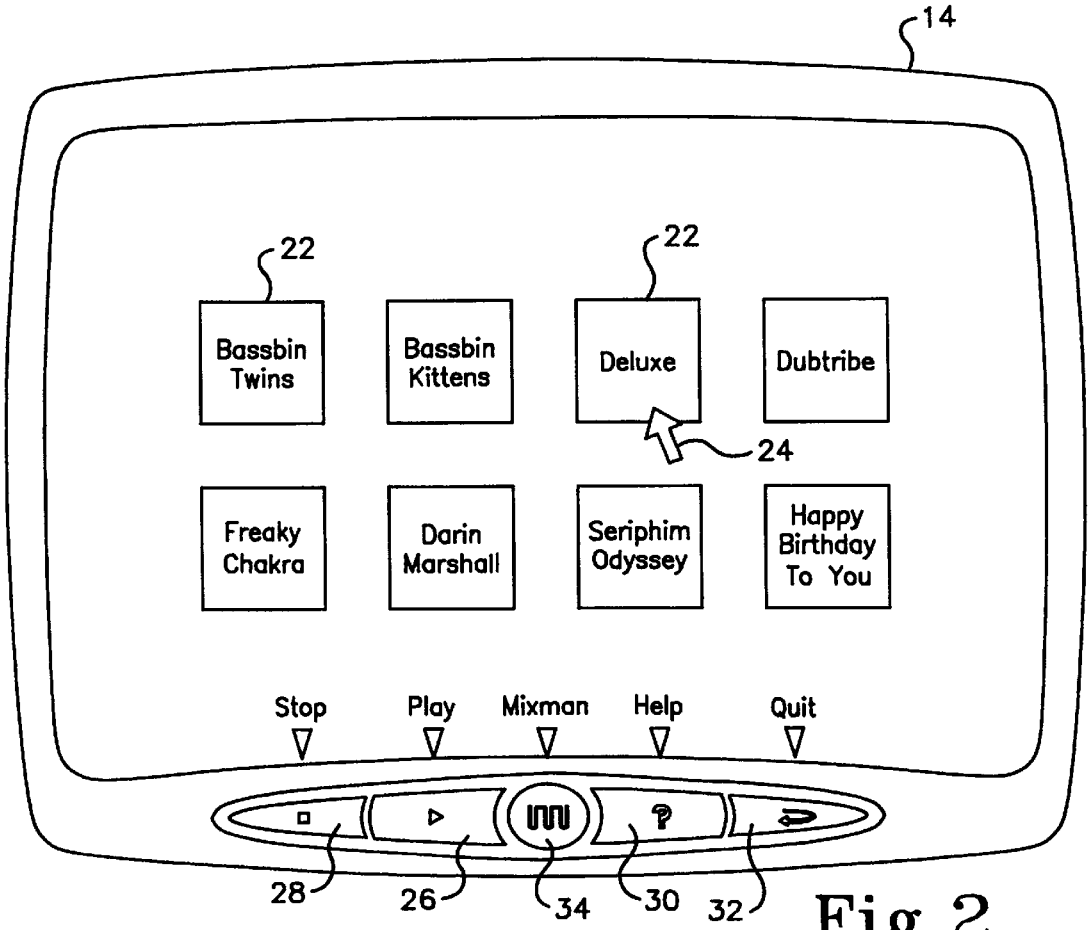
FIG. 2 illustrates a sample selection screen from which a user may select a song to play.

FIG. 2 illustrates a main selection screen which is displayed on the monitor 14 to indicate available sets of sound sequences, typically songs, which may be selected by the user. As shown, the main selection screen displays icons in the form of titles 22 of songs which are included in the software package.

The user, utilizing the keyboard 18 or joystick 20, selects one of the songs by moving an arrow icon 24 to the title of the song, and pressing a selection button on the keyboard 18 or joystick 20.

The user further has the option of using the system 10 as a conventional cassette or CD type player. In this mode, the user can play the commercial version of the song by moving the arrow icon 24 to a play button icon 26 which is displayed at the bottom of the monitor screen and pressing the select button. The user can stop playing the song by means of a stop button icon 28. Further illustrated are a help button icon 30 for calling up on-line help screens, and a quit button icon 32 for terminating operation of the system 10. Although not shown, other button icons such as fast forward reverse, skip, etc. can be provided.

Figure 3:
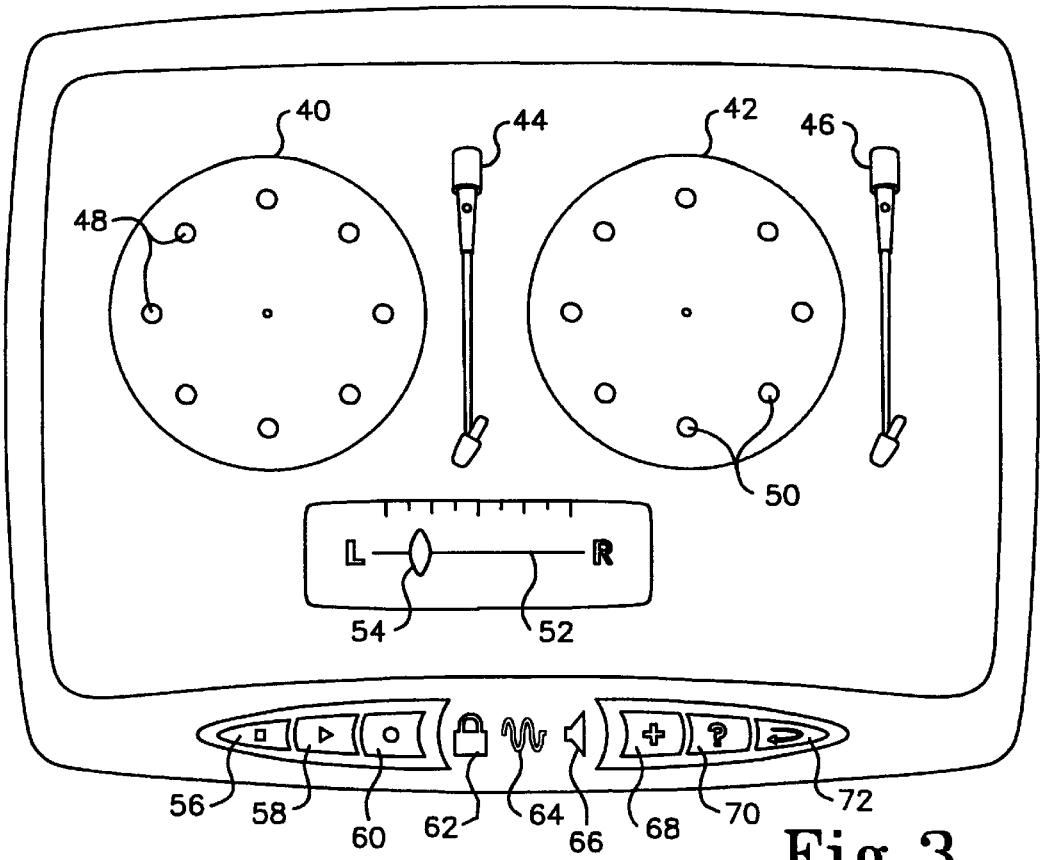
FIG. 3 illustrates a screen which is selectable from the screen of FIG. 2, and displays icons indicating which tracks are selected and de-selected.

After selecting a song title, the user can use the system 10 for its main purpose of interactive musical performance by selecting a Mixman button 34. This calls up a Mixman screen which is illustrated in FIG. 3.

Although the Mixman screen can have any desired configuration, the illustrated preferred example is a depiction of a double phonograph record turntable of the type used by radio and dance club disk jockeys, including two record turntables 40 and 42 with associated tone arms 44 and 46.

Each turntable 40 and 42 is depicted with eight button icons which are collectively designated as 48 and 50 respectively. The icons 48 and 50 can be selected using the joystick 20, which is conventionally capable of designating eight different directions. Alternatively, the icons 48 and 50 may be selected using the numeric keypad or other keys on the keyboard 18.

Each icon 48 and 50 corresponds to a note sequence or sound track which is associated with the selected song. Due to the correspondence of the sound tracks and the joystick directions, the sound tracks corresponding to the buttons 48 and 50 are alternatively referred to herein as "direction tracks" or "directions".

The user can switch between the turntables 40 and 42 to select and de-select a total of 16 (two sets of 8) direction tracks, even though the input device may be only capable of designating 8 different directions. Furthermore, the invention is not so limited, and any number of sets of eight directions can be provided, with means for switching between the sets. Also, each set need not include eight directions, but can have any suitable number of directions.

It is further within the scope of the invention to provide the player and input device with different numbers of directions, and alternatively to provide sound tracks for only subsets of directions. For example, the player can be capable of handling 20 directions with the input device being capable of inputting only 16 directions, or vice-versa. In this case, the number of directions used is the smaller of the two.

One button 48 may represent, for example, a drum track for the selected song, and another button 34 may represent the lead guitar track for the selected song. Initially, when no direction track is selected, the icons 48 and 50 are not lit.

When the user, using the keyboard 18 or joystick 20, selects one or more of the direction tracks to be played, the icon 48 or 50 representing the selected track is lit in a particular color.

For example, if the user selects the drum track of the song to be played, the corresponding icon 48 or 50 may be lit green. If the user locks on the drum track, which means that the drum track is to be continuously played until unlocked or de-selected, the icon may be lit yellow. The icons for each of the tracks may be lit using different colors or shapes to distinguish the selection or de-selection statuses of the sound tracks.

Icons can also pulsate in rhythm with the beat, or have different intensities to indicate the status of the tracks.

In addition to the direction track icons, the Mixman screen as illustrated by FIG. 3 may display other information. A scale 52 and associated sliding knob icon 54 may be used to indicate which of the two turntables 40 and 42 has been selected by the user.

Alternatively, the scale 52 and icon 54 may be used to indicate the progression of the song being played. For example, the icon 54 may be positioned at the leftmost point of the scale 52 at the beginning of the song, slowly move toward the right as the song is played, and reach the rightmost position of the scale 52 as the song ends. Combinations of scales and icons are also contemplated.

The Mixman screen illustrated in FIG. 3 also includes control button icons which may be selected to control the playing of the song and the various direction tracks. For example, an icon 56 pauses or stops the playing of the song, and an icon 58 starts or resumes playing. An icon 60 records the current session of the song and the selected directions such that the current sound mix may be replayed at a later time.

An icon 62 locks a direction track being played, which means that the direction track, even when de-selected by the input unit, will continue to play. An icon 64 provides special effects for the selected direction track, including echo, reverberation, and/or other predetermined sound processing. It is further within the scope of the invention to achieve the experience of a musical solo of an instrument by selecting several tracks in combination with each other.

An icon 66 mutes the basic track and/or the direction tracks, and plays a predetermined sound sequence such as a break track as will be described below. When the icon 66 is de-selected, the basic track and/or the direction tracks may resume at the point they were muted or may resume at the current time sequence.

An icon 68, when selected, allows the user to set other options for the playing of the selected song by displaying other option commands or option icons. An icon 70 provides help to the user by visually displaying help information on the screen or providing audio help using the speakers 16. An icon 72 stops playing of the selected song and causes the monitor 14 to display the main selection screen as illustrated by FIG. 2.

Figure 4A:
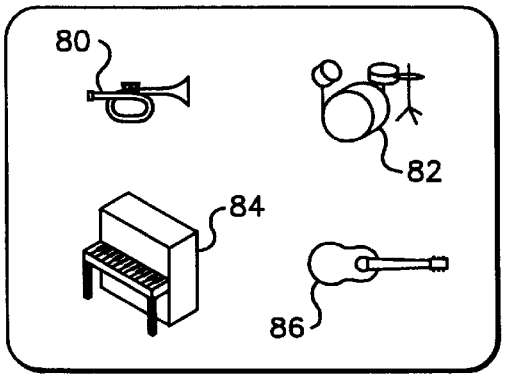
FIGS. 4*a* and 4*b* are diagrams illustrating a graphic user interface (GUI) display of the present system.
Figure 4B:
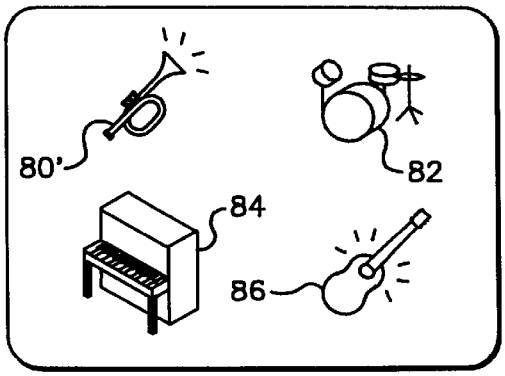

The direction track and control icons may be implemented using other methods and techniques without departing from the scope of the present invention. For example, FIGS. 4*a* and 4*b* illustrate an graphical user interface (GUI) display for controlling the playing of the musical sequences. The display of FIGS. 4*a* and 4*b* is an alternative to the Mixman screen illustrated in FIG. 3.

In this embodiment of the invention, the monitor 14 displays pictorial icons which represent the direction tracks for the selected song. Rather than lights or buttons as described above, the icons are pictorial representations indicating the musical content of the tracks and/or the musical instruments which produce the sounds on the tracks.

As illustrated, icons 80, 82, 84 and 86 represent trumpet, drums, piano and guitar direction tracks respectively. In FIG. 4*a*, none of the direction tracks are selected. In FIG. 4*b*, the trumpet direction track is selected, and the trumpet icon, designated as 80', has a shape which is different from the de-selected icon 80. Rather than providing different shapes for selected and de-selected icons, it is within the scope of the invention to display selected and de-selected icons with different colors.

The display screens illustrated in FIGS. 4*a* and 4*b* are not shown as including control icons or buttons. In this embodiment of the invention, buttons on the input device control the various functions and options of playing a selected song.

For example, if the input device is the keyboard 18, the various control buttons may be implemented as certain sequences of keystrokes. If the input device is the joystick 20, it may have various buttons or movement sequences that correspond to the control icons described above.

Figure 5:
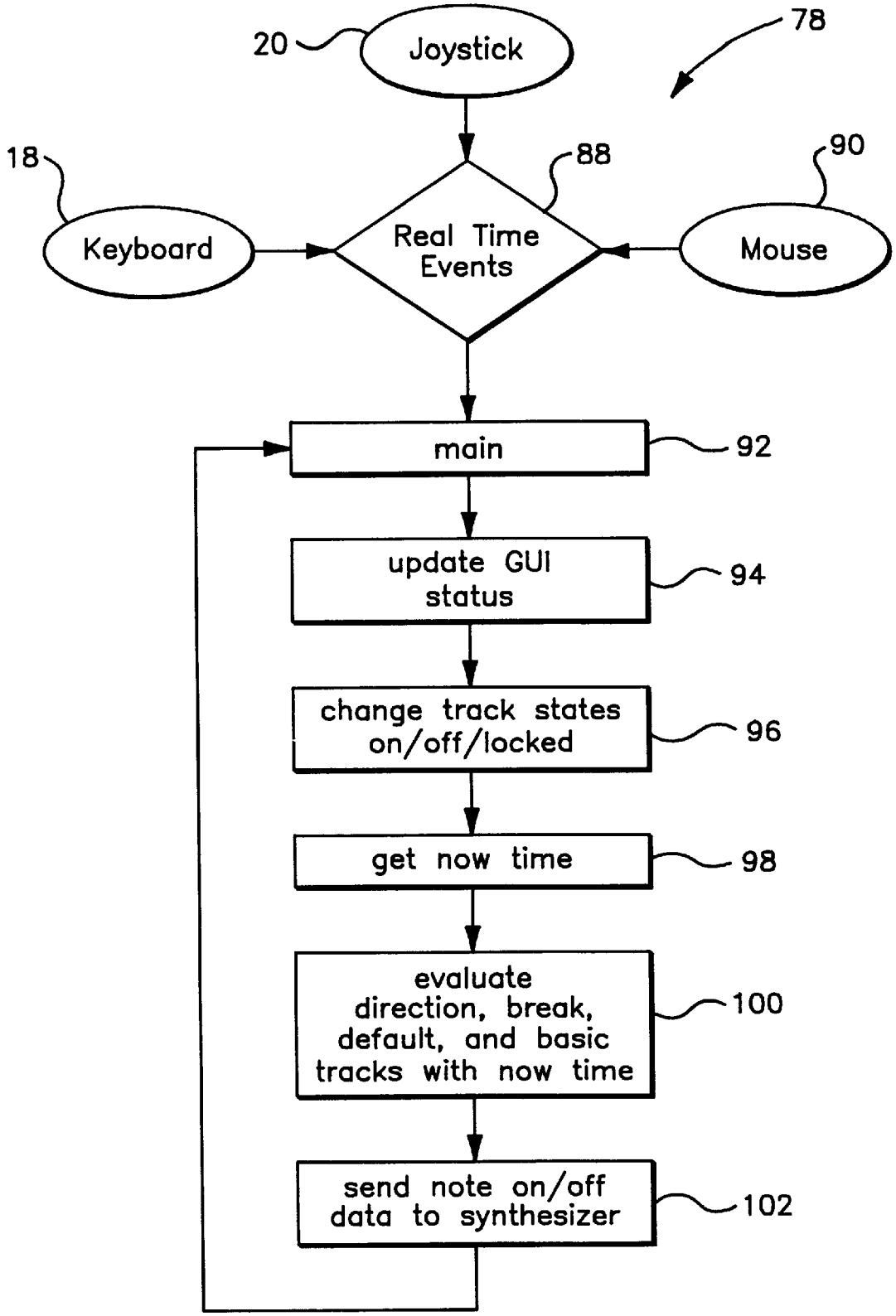
FIG. 5 is a flowchart illustrating the operation of a GUI according to the present invention.

FIG. 5 is a flowchart of a GUI 78 for implementing the functionality of the system 10. The GUI 78 is provided in the form of a software program which is hardwired into the system 10, or provided on a floppy disk, CD-ROM or the like and loaded into and run by the system 10. The software can also be downloaded from the internet or other source.

The GUI 78 continuously senses the keyboard, joystick 20, and/or an alternative input unit such as a mouse 90, to determine when the user is inputting a command into the system 10 as a real time event in a step 88. Upon sensing an input, the input data is passed to a main step 92 of the GUI 78, which updates the GUI status in a step 94, and changes the states of direction tracks in accordance with the input data in a step 96.

The GUI 78 then gets the current or "now" time in a step 98, evaluates the current state of the direction, break, default, and basic tracks in a step 100, plays the required sounds for the selected tracks at the current time by sending the data to an output synthesizer in a step 102, and loops back to the main step 92. The loop of analyzing the user inputs and the current time sequence, and playing the corresponding sound or sets of sounds is repeated until the song being played is finished.

Figure 6:
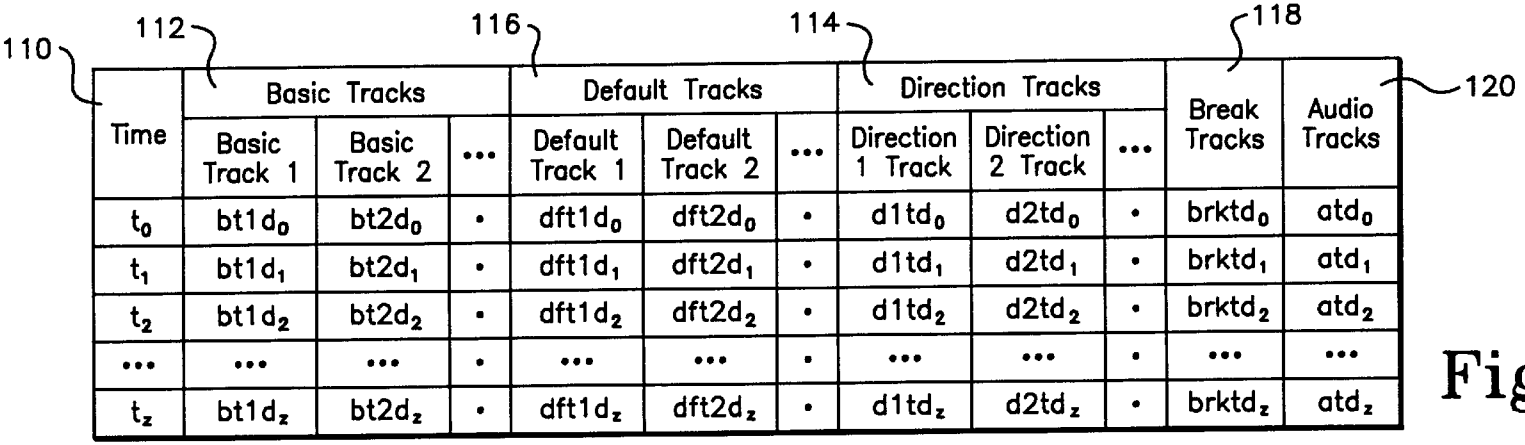
FIG. 6 is a timing diagram illustrating the sound tracks and their relationship to a time base.

As described above, the monitor does not necessarily have to display icons or buttons for any or all of the available functions of the system. In a preferred embodiment, all required functions may be made available from the system using various combinations of inputs such as icon buttons, keyboard input, or mouse or joystick selections:

As illustrated in FIG. 6, the present system 10 provides the basic song track or sequence, direction or sound tracks, and other tracks as will be described below, in parallel for the entire length of the song. The tracks are referenced to a time base which includes discrete time slots. Each musical note in a track or sequence is referenced to one or more time slots in the time base.

When the system 10 is launched, and the user has selected a song to be played, and the GUI 78, following the procedure illustrated in FIG. 5, begins to play the basic track of the song. FIG. 6 illustrates a time base 110 including time slots $t_0$, $t_1$, . . . $t_z$, et seq. The song begins at $t_0$ and ends at $t_z$.

Basic tracks 112 are a plurality of standard MIDI files, one for each song that can be selected from the main screen of FIG. 2, which contain the data that will play when the song is selected even when the user does nothing. The basic tracks 112 may have any number of sub MIDI tracks on any number of different MIDI channels.

Only two basic tracks 112 are shown in FIG. 6 for simplicity of illustration, and include musical note data $bt1d_0$ to $bt1d_z$, etc., which can be notes of any pitch and/or duration, or blank space data corresponding to periods of silence. The subscripts in the note data $bt1d_0$ to $bt1d_z$, etc. correspond to the subscripts in the time slots $t_0$ to $t_z$, thereby providing a one-to-one mapping between the note data and the time base 110.

Direction tracks 114 comprise standard MIDI files that contain the data for each of the available sound sequences for the selected song. In the preferred embodiment, there are 16 direction tracks for each basic track 112, with each direction track being limited to one unique MIDI channel. The MIDI channel number of a direction track determines its position on the joystick 20. Shift_ in the following table refers to the second set of 8 directions accessed by pressing a shift key on the joystick 20 while selecting a direction track 114.

The system 10 further comprises default tracks 116, which are also standard MIDI files. The default tracks 116 follow the same MIDI Channel Assignment scheme as the direction tracks 114. The default tracks MIDI channel numbers correspond to their position on the joystick in the preferred embodiment. The default track of a channel is played when the user selects the direction track for that channel and, at the time of the selection, the direction track data is blank (consists of a space).

The purpose of the default tracks 114 is to give the illusion that in every track there is always data to be played. For example, a particular direction track may contain a melody. At any instant in time during the song, the melody may or may not have a note associated with that particular point in time. If the user selects the direction track to be played during a time for which there are no notes to be played, the user may feel that the system was malfunctioning.

To provide to the user the illusion that there is music to be played for each and every direction track at any time the user selects the direction, when the direction containing a space at the time of the selector is selected, the system plays data from the default track of that direction until data in the direction track occurs. Then, the direction track data is picked up by the system and played.

If the selected track data is repeated during the course of playing the song, and if the user maintains the selection of that direction track long enough to get to the same place in the melody, the space in the melody will be preserved and the direction will be silent for the specified length of time.

In summary, the data in the default track is only played when the user selects the direction track, and the direction track has no sound to be played at that particular time.

The default track may be set to one of four modes of operation: always mode; till next note (TNN) mode; not locked (NL) mode; and on-lock only mode (OLO). When the default track mode is set to always, the default track for the direction track plays when the user has selected that direction track, or if that direction track has been locked on. The default track can also be set to play only when the corresponding direction is locked on.

When the default track is set to TNN mode, the default track for the direction track plays when the user selects that direction track, and the default track stops playing at the next occurrence of a note on that direction track. When default track is set to TNN mode, the default track does not play when that direction has locked on. When the default track is set to NL mode, the default track plays as long as the user has selected that direction track, but not when that direction track is locked on.

Break tracks 118 are constituted by a standard MIDI file containing the MIDI data which is played when the user selects a break button or icon. Pressing the break button mutes the basic track while allowing any locked or selected direction tracks and the break track to play.

The break track is an exclusive alternative track to the basic track. When the break button is released, the basic track picks up where the song is now, not where it left off. For example, if the break button was pressed at time $t_2$, the basic track data would be muted, and the break track data will be played starting at time $t_3$ until the break button is released. If the break button is released at time $t_5$, the break track data would no longer play, and the system 10 will resume playing of the basic track data beginning at time $t_6$.

All the data for the various sound tracks discussed above, basic track data, direction track data, default track data, and break track data are provided as MIDI data in standard MIDI files. In addition, because there are likely to be various instrumental song sequences of the selected song, the data for the entire song is not likely to be required to be stored in memory; rather, only the unique segments of the instrumental tracks of the song are stored and the other segments are played as repeats of the stored segments.

The present system is further capable of playing audio data such as song vocals. This data is stored in audio tracks 120, which are provided as a stereo digital audio file in AIF format for the entire length of the song. The audio track data may alternatively be read from a CD ROM drive. The audio tracks 120 are used to accommodate musical content such as lyrics that are always changing and would otherwise take up too much space in the memory if stored as a MIDI file.

Figure 7:
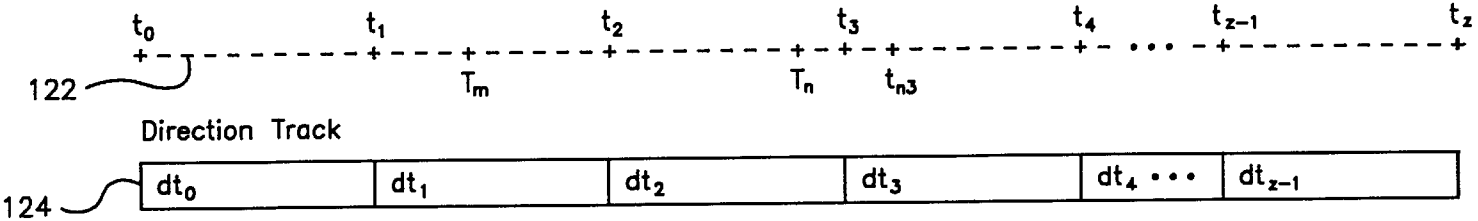
FIG. 7 is a timing diagram illustrating a harmonic follow mode according to the invention.
Figure 8:
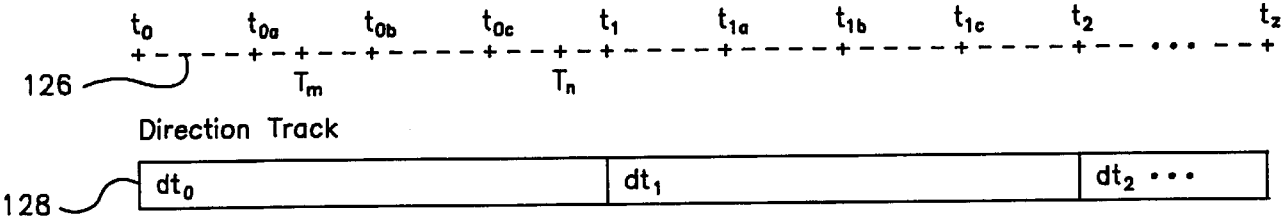
FIG. 8 is similar to FIG. 7 but illustrates a quantized harmonic follow mode.
Figure 9:
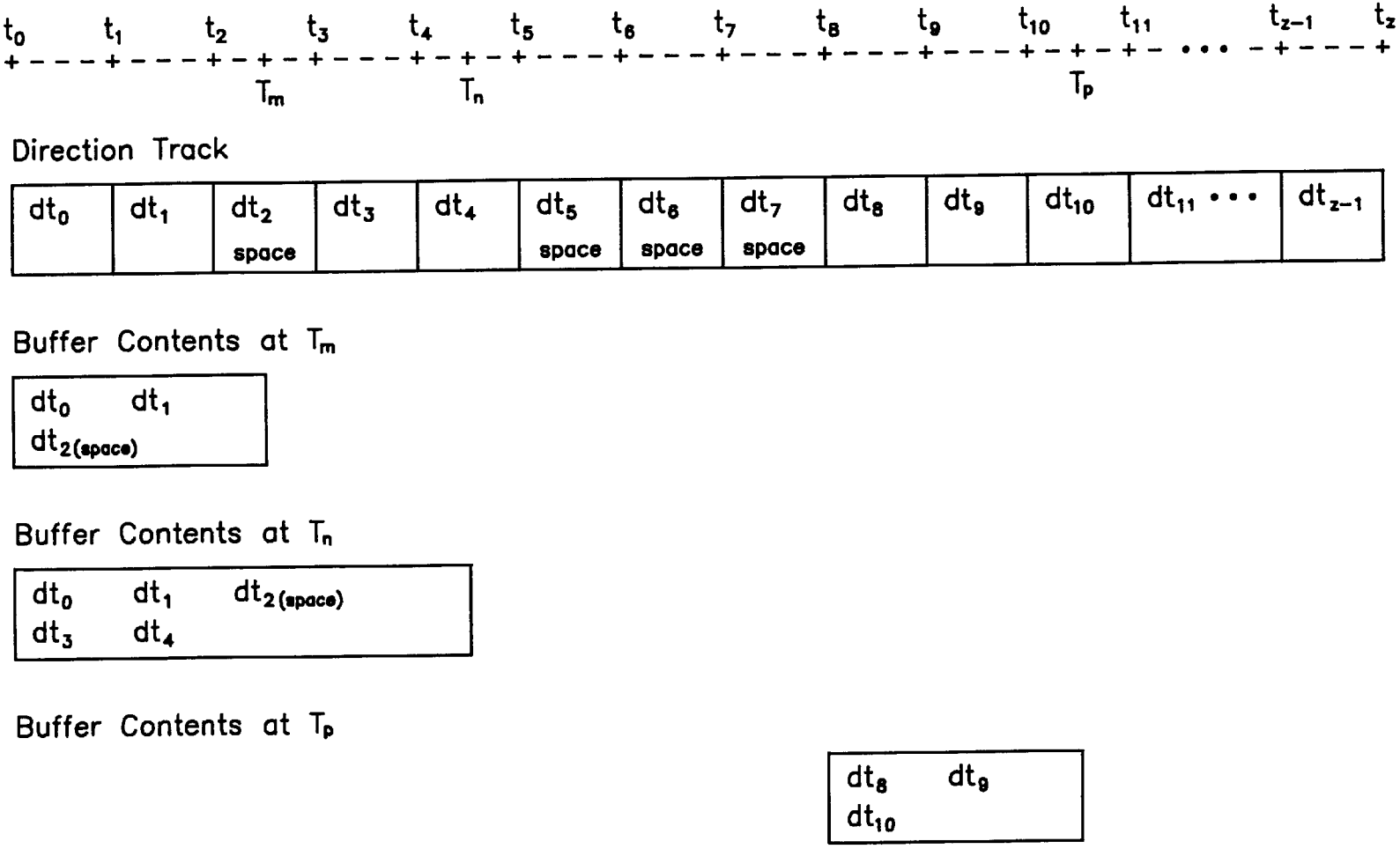
FIG. 9 is similar to FIG. 7, but illustrates a resetting mode.

FIGS. 7 to 9 illustrate different modes of synchronization and system functions performed by the system 10 to produce and synchronize the various sound tracks. These synchronization methods and functions determine the system's response to user selections of various tracks and functions.

The synchronization methods, also referred to as modes of interaction, are predetermined on a per track basis by the programmer of the system. Each sound track may be set to interact in a different mode. Once set, the mode of interaction for any particular track remains consistent throughout the song.

Certain modes may have one or more parameters that determine their functionality. The modes of interactions are: normal, harmonic follow, mono non-quantized (HF-MNQ), harmonic follow mono quantized (HF-MQ), harmonic follow poly non-quantized (HF-PNQ), harmonic follow poly quantized (HF-PQ), resetting non-quantized (RNQ), resetting quantized (RQ), and resetting one-shot (ROS).

Referring now to FIG. 7, the time progressions are illustrated by the time base and time slot designations $t_0$ to $t_z$ as shown in FIG. 6. At time $t_0$, the basic track of the selected song begins to play, and at time $t_z$ the song is completed. At any time between $t_0$ and $t_z$, the user may select one or more direction tracks to be played superimposed upon the basic track.

Direction track data 124 represents the direction track data that would be played at each timed interval if selected. In the normal mode, when the user selects a direction track, the direction track data is not played until the next note in the sequence.

For example, when the user selects the direction track in normal mode at the time $t_m$, the direction track data is not played until the time indicated by $t_2$. At time $t_2$, the data of the direction track $dt_2$ is played. The direction track is silent between the time periods $t_m$ to $t_2$.

For example, if the MIDI data for the selected track is constant 16th notes, and the tempo of the song is 120 beats per minute (bpm), there will be periods where there is no note data (silence) in the track between the 16th notes. If the user selects the direction track during one of these periods, nothing will be heard until the next 16th note actually occurs. The normal mode is typically used when data for the tracks is sufficiently dense that the effects of any silent periods are minimal.

If the sound sequence of a direction track is not sufficiently dense, and presence of the silent periods is unacceptable for the particular direction track, the direction track may be programmed to use the harmonic follow mono non-quantized (HF-MNQ) mode. In the HF-MNQ mode, a buffer is set up to store the last note (most previous note) which would have played for the direction track had the user selected the direction.

When the user selects the direction track configured with the HF-MNQ mode, the note in the buffer plays immediately. The note plays until either the user de-selects the direction track, or the next note in the direction track is to be played.

Referring to FIG. 7, if the direction track 124 has been programmed to use the HF-MNQ mode of interaction, at each timed interval, a buffer stores the direction track data that would have played had the direction track been selected. For example, at time $t_1$, data $dt_1$, would have been stored in the buffer. If the user selects the direction track at $t_m$, instead of waiting until $t_2$ to play data $dt_2$ and allow a silent period between $t_m$ and $t_2$, the buffer which is holding $dt_1$, is played immediately at the time $t_m$. Then, at $t_2$, data $dt_2$ is played.

The immediate response of the system, as provided by the HF-MNQ mode, serves an important function of providing immediate audio response upon selecting a direction track. However, it may also cause unwanted side effects when the user selects the direction track a fraction of a second before the beginning of the next note. For example, if the user selects the direction track 124 at $t_n$, the data $dt_2$ is played at $t_n$, and is immediately followed by data $dt_3$ at time $t_3$, creating an unwanted "double attack".

To eliminate the possibility of double attacks, a follow delay (FD) is introduced. FD is a predetermined delay time, unique to each direction track using the harmonic follow mode. The delay time is designed such that a note is played only after a sufficient time has passed since the playing of the previous note.

For example, referring to FIG. 7, in the harmonic follow non-quantized mode, if the user selects the direction track 124 at the time $t_m$, the data $dt_2$ stored in the buffer plays immediately at $t_n$. However, the data $dt_3$ which would have otherwise played at time $t_3$ now plays at $t_{n3}$ because the follow delay interval is longer than the period of time between $t_m$ and $t_3$.

The length of the follow delay is predetermined by the programmer of the system for each individual direction track. In FIG. 7, the follow delay is not utilized if the user selects the direction track 124 at $t_m$, because the length of time between $t_m$ and $t_2$ is greater than the value of the follow delay.

The harmonic follow mono quantized (HF-MQ) mode of interaction is illustrated by FIG. 8. A time progression line 126 and time intervals $t_0$ to $t_z$ are further subdivided, or quantized, to smaller quanta of time.

In this mode of interaction, each time interval is subdivided into four quanta of time. For example, the time interval between $t_1$ to $t_2$ is divided into intervals $t_1$ to $t_{1a}$, $t_{1a}$ to $t_{1b}$, $t_{1b}$ to $t_{1c}$ and $t_{1c}$ to $t_2$.

The operation of the HF-MQ mode of interaction is the same as the operation of the HF-MNQ mode with one exception. When the user selects a direction track, the note in the buffer is held until the next time quantum to be played.

For example, in the HF-MNQ mode, when the user selects a direction track 128 at a time $t_m$, the direction track data $dt_0$, which would have been stored in the buffer, is immediately played. However, in the HF-MQ mode, when the user selects the direction track 128 at $t_m$, the data in the buffer $dt_0$ is played at the next time quantum which is at $t_{0b}$.

The harmonic follow poly non-quantized (HF-PNQ) mode of interaction is similar to the HF-MNQ mode except that the buffer is capable of storing not only single notes, or mono data, but chords as well.

For the HF-PNQ mode, an additional parameter of chord threshold is set which dictates the period of time the buffer looks at a group of notes to form them into a chord. For example, the HF-PNQ mode is used to store a chord in which the notes are not hit simultaneously, but like a fast arpeggio as in jazz piano tracks. The longer the chord threshold time, the more notes could potentially be stored in the buffer as a chord.

The harmonic follow poly quantized (HF-PQ) mode of interaction is similar to the HF-PNQ mode, except that when the user selects a direction track programmed using the HF-PQ mode, the notes in the buffer wait until the next time quantum to be played.

The resetting non-quantized (RNQ) mode of interaction functions similarly to the harmonic follow modes of interaction. However, unlike the harmonic follow modes of interaction such as the HF-MNQ mode where the buffer stores a single note, in the RNQ mode, the buffer stores a plurality of notes from the direction track. Then, when a direction track programmed with the RNQ mode is selected during a silent interval represented by a "space" in the direction track, the buffer containing the multiple notes is repeatedly played until the next sound data is found in the selected direction track.

In the RNQ mode, a new parameter, sequence threshold time (STT), determines the length of time the buffer is accepting data to be stored which will be played when the user selects the direction track. The length of the STT determines the number of notes in the direction track that will be stored in the buffer to be played upon the selection of the direction track during a silent interval.

To fill the buffer for the direction track in the RNQ mode, the buffer is sequentially filled with notes from the direction track whether or not the direction track is selected by the user. After every new note is added, the STT is reset to 0. Any notes that occur in the direction track before the STT expires will be included in the sequence in the buffer.

When the user selects the direction track during a space in the sequence, the sequence in the buffer is played. Upon every new entry into the direction track, the buffered sequence plays from the beginning. When the STT expires and new data is found in the direction track, the current contents of the buffer are cleared and the buffer is filled with the new data as the first note. Using carefully chosen STT values and blank spaces in the direction track sequences, this operation may be used to play different phrases for different parts of a song.

FIG. 9 illustrates the operation of the RNQ mode. Beginning at time $t_0$, notes are stored in the buffer. If the user selects the direction track at time $T_m$, the notes in the buffer, which at time $T_m$ are $dt_0$, $dt_1$, and $dt_2$, are played until $t_3$ at which time the note $dt_3$ is played. If the user selects the direction track at time $T_n$, the notes in the buffer, which at time $T_n$ are $dt_0$ through $dt_4$, are played until time $t_8$ at which time the note $dt_8$ is played.

If the user selects the direction track at time $T_p$, the notes in the buffer, which at time $T_p$ include $dt_1$, through $dt_6$ (space), are played to fill in the space between $T_n$ and $t_8$. Then, at time $t_8$, the note $dt_8$ is played.

Assuming, for example, that the current STT value is two time units, at time $t_8$, the buffer would be cleared of the notes $dt_0$ through $dt_7$ and begin to be filled with the data $dt_8$ as the new first note in the buffer. This is because two "spaces," $dt_5$ and $dt_6$, caused the STT to expire, and a new note $dt_8$ is encountered after the expiration of the STT. Therefore, if the user selects the direction track at time $T_p$, the buffer containing notes $dt_8$ through $dt_{10}$ is played until $t_{11}$ when $dt_{11}$ is played.

The resetting quantized (RQ) mode of interaction functions similar to the RNQ mode with one exception. When the user selects the direction track programmed with the RQ mode, the sequence in the buffer waits until the next time quantum to be played.

The resetting one-shot (ROS) mode can be either non-quantized or quantized, and is similar to the resetting modes described above except that the sequence in the buffer plays once completely, even if the direction track is de-selected during the sequence.

A direction cancellation function may be programmed for each individual direction track. If a particular direction track has a cancellation function, when the direction track is selected, it cancels one or more predetermined other tracks which are being played and locked on.

The purpose of the cancellation function is to eliminate possible clashes of non-complimentary direction tracks. For example, when a direction track contains sound sequences of a saxophone solo and another direction track contains sound sequences of a trumpet solo, the developer may choose not to allow the user to select both tracks to be placed simultaneously.

In such a case, both the trumpet solo and the saxophone solo direction tracks would be programmed such that selection of one direction track will cancel the playing of the other direction track.

Cancellation of a direction track does not mean that the canceled direction track is de-selected or unlocked. Instead, the direction track being canceled stops playing for the duration that the new direction track is playing. After the new direction track is de-selected or unlocked, the canceled direction track resumes playing.

A break function may be made available to the user such that when the user selects the break function by pressing the break icon or the break key, certain other direction tracks or basic tracks are muted. For example, the developer may choose to have all of the rhythmic direction tracks stop playing while in the break mode to give the break track a very different sound. Again, when the break mode is de-selected, the muted tracks resume playing.

In addition to above described modes of interaction, each song may have a delay parameter which may be activated or deactivated by the user. When activated, a predetermined delay level may be used as a multiplier for "note on" commands before they are routed to the delay module. The delay may or may not be activated at the time the song is loaded, but if activated, it may be selected by the user via a special effects (FX) button.

The delay module is a MIDI delay that sends additional note on commands based on input. There is only one delay time setting per song. The delay module takes notes and sends a delayed version to the sound engine.

The output of the delay module has a feedback loop. The notes that feed back into the delay module are first multiplied by the feedback value. This continues until the amplitude of the note is equal to or lower than an amplitude-cutoff parameter.

For example, one note is sent to the delay module. The note comes from the snare track of a song. The user has momentarily held down the FX button thereby sending one note to the delay module. The note has an original velocity value of 90. The delay-level for that direction is 50%, so the snare is sent to the delay module with a delay value of 45.

The feedback value is set to 50%, and the delay time is set to 200 milliseconds. In this case, the first note to be triggered by the delay module would be a snare sound of velocity 23 (45*Feedback), 200 milliseconds after the time the note was sent to the delay module.

The delay-mode parameter determines which outputs the sound should come from. In the mono mode, the delayed sounds are set to both outputs. In the stereo mode, the delays alternate between channels. In the same as source mode, delayed versions of sound are sent to the same channel as the sound that triggered the delay.

Figure 10A:
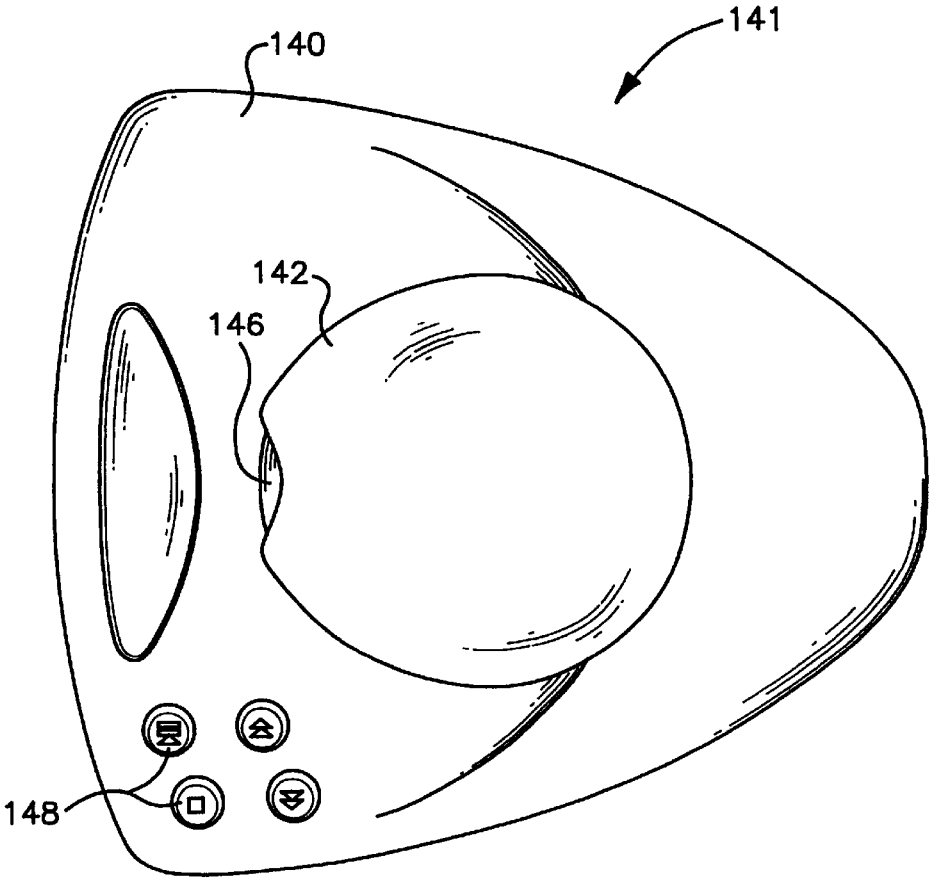
FIG. 10*a* is a plan view of a joystick input device of the present system.
Figure 10B:
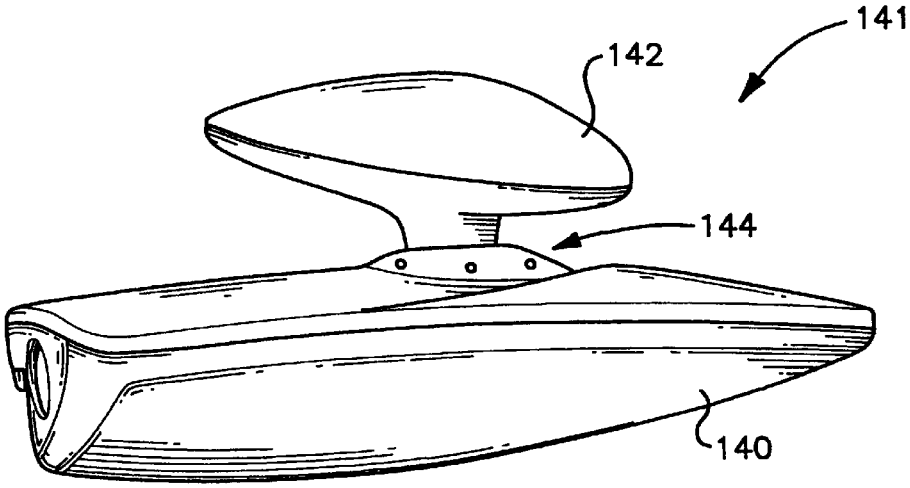
FIG. 10*b* is a side elevation of the device of FIG. 10*a;*

FIGS. 10*a* and 10*b* illustrate one embodiment of a joystick for inputting selections into the system 10. A joystick 141 comprises a body 140, and an enlarged knob 142 which is connected to the body 140 via an actuator linkage 144 which allows the knob 142 to be moved in eight directions:

Up,
Up_Right,
Right,
Down_Right,
Down,
Down_Left,
Left, and
Up_Left.

In the preferred embodiment, these eight directions are used to select and de-select eight different direction tracks. A button 146 built onto the knob 142 may be used as the shift button, which, in combination with the eight directions, creates eight additional directions:

Shift_Up,
Shift_Up_Right,

Shift_Right,

Shift_Down_Right,

Shift_Down,

Shift_Down_Left,

Shift_Left, and

Shift_Up_Left.

In addition, the joystick 141 may have a plurality of control buttons which are collectively designated as 148, and which may be configured to control various functions of the system 10 in place of or in addition to the icon buttons available on the screen.

The user holds the base 140 in his or her left hand from below, with the fingers pointed leftwardly as viewed in the drawings, moves the knob 142 with the right hand, and depresses the shift button 146 and the buttons 148 with the left or right forefinger.

Although not explicitly shown for simplicity of illustration, the joystick 141 may be further provided with a backstrap which extends from the base 140 around the back of the user's left hand to attach the joystick 141 to the hand. This frees the user's left fingers from the necessity of supporting the joystick, and facilitates the use of the left forefinger to depress the buttons 148. It is further within the scope of the invention to provide additional control buttons in on the backstrap.

Figure 11A:
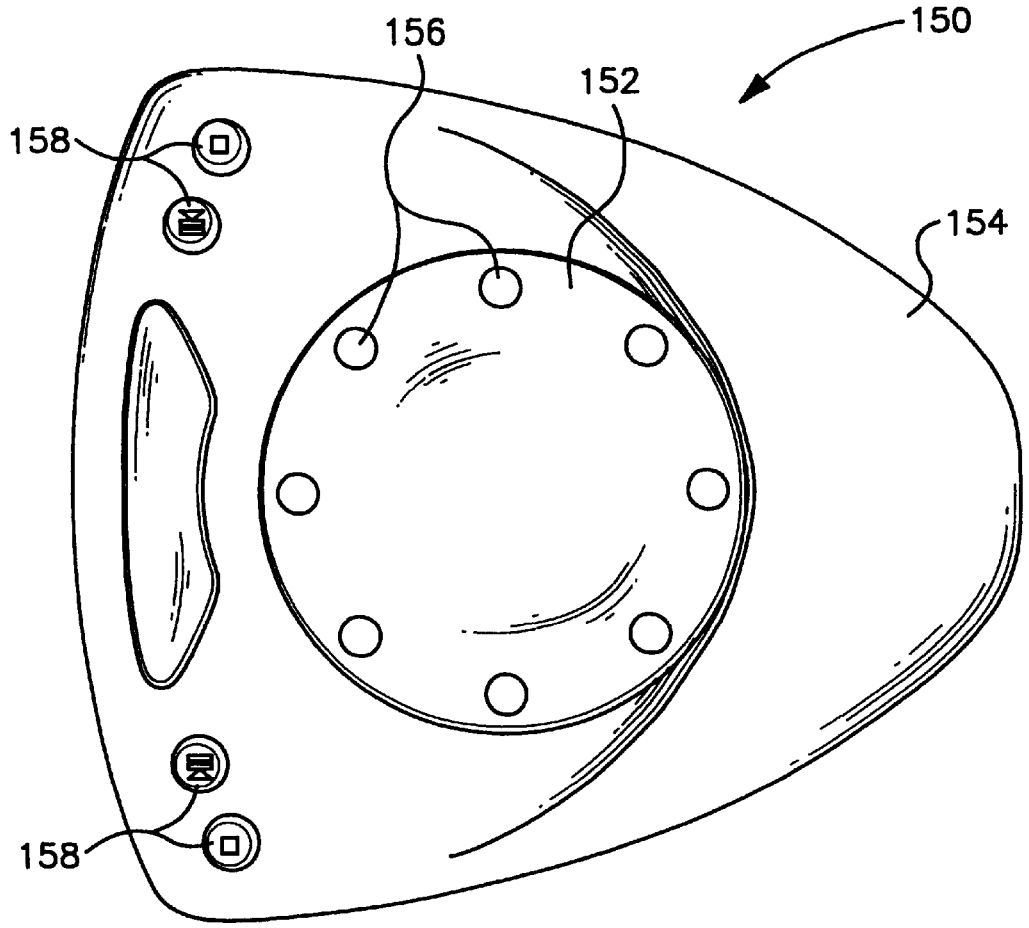
Fig. 11*a* is a plan view of another joystick input device of the present system.
Figure 11B:
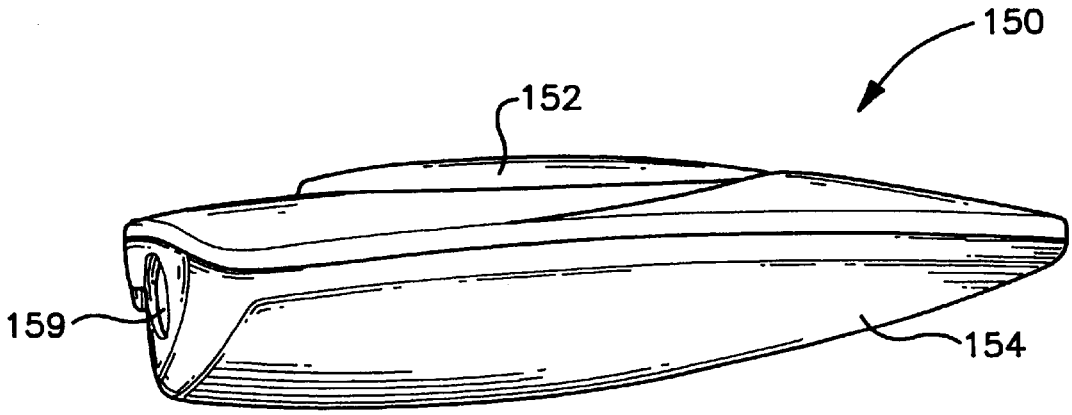
FIG. 11*b* is a side elevation of the device of FIG. 11*a;*

FIGS. 11*a* and 11*b* illustrate another joystick 150 embodying the present invention. The joystick 150 comprises an enlarged disk portion 152 which is mounted on a base 154, and has eight direction buttons which are collectively designated as 156 provided thereon.

The eight direction buttons 156 correspond to the eight directions respectively, and a direction track is selected by depressing the corresponding button 156. The buttons 156 may be illuminated such that they light up when the corresponding direction track is selected and/or locked. The joystick 150 is further provided with control buttons which are collectively designated as 158, a shift button 159, and may further comprise a backstrap as described above.

Figure 12C:
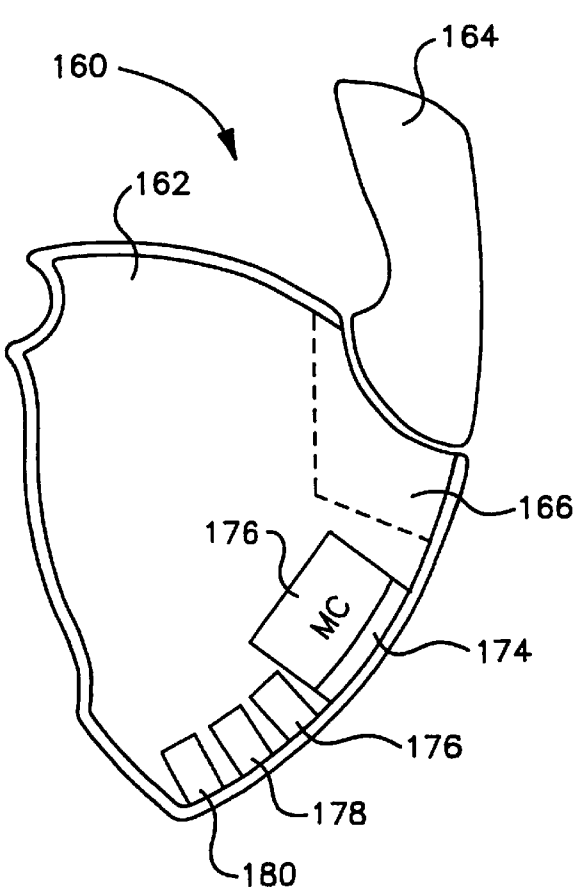
FIG. 12*c* is a diagrammatic side elevation of the device of FIGS. 12*a* and 12*b;*
Figure 12B:
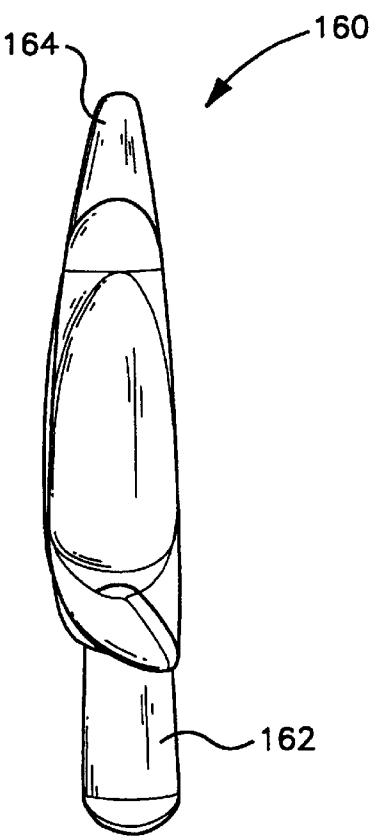
FIG. 12*b* is a front elevation of the device of FIG. 12*a;*
Figure 12A:
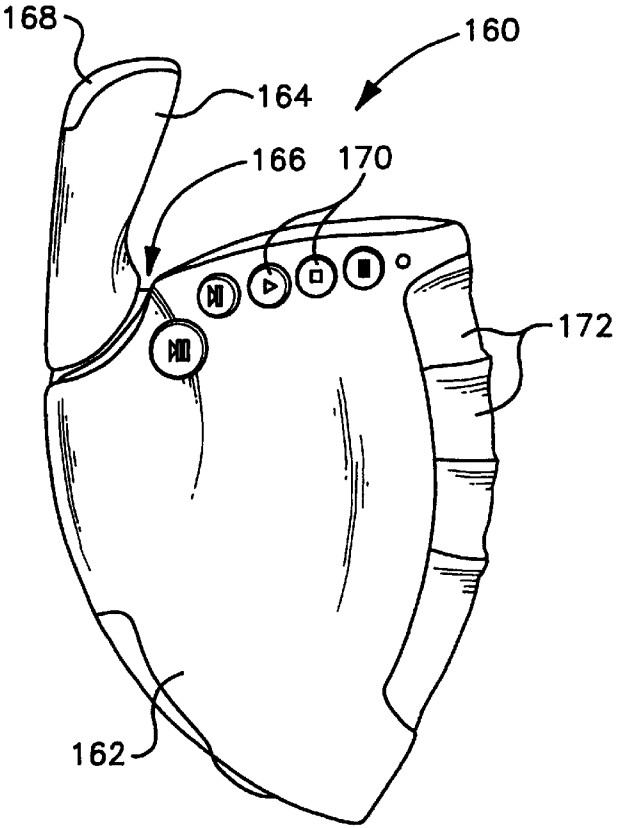
FIG. 12*a* is a side elevation of another joystick input device of the present system.

FIGS. 12*a*, 12*b* and 12*c* illustrate another joystick 160 according to the present invention. The joystick 160 comprises a base 162, and a handle 164 which is connected to the base 162 via an actuator linkage 166 that allows the handle 164 to be moved in eight directions. A shift button 168 is provided in the handle 164 to switch between two sets of eight directions.

The joystick 160 further comprises control buttons 170 to control various functions of the system. In addition, four more control buttons 172 are configured as finger grips, such that four fingers of the user's hand ergonomically engage with them for easier control. Such ergonomic design is one of the important aspects of this particular implementation of the input device. The joystick 160 may further comprise a backstrap as described above.

FIG. 12*b* illustrates the internal structure of the joystick 160, including a socket 174 for receiving a ROM memory card which may contain data representing sound sequences for the system to play. In addition, the joystick 160 is provided with an audio signal output port 176 which enables the user to connect amplifiers or speakers to the joystick 160. The joystick 160 is further provided with a headphone jack 178 and a power cord socket 180.

Figure 13A:
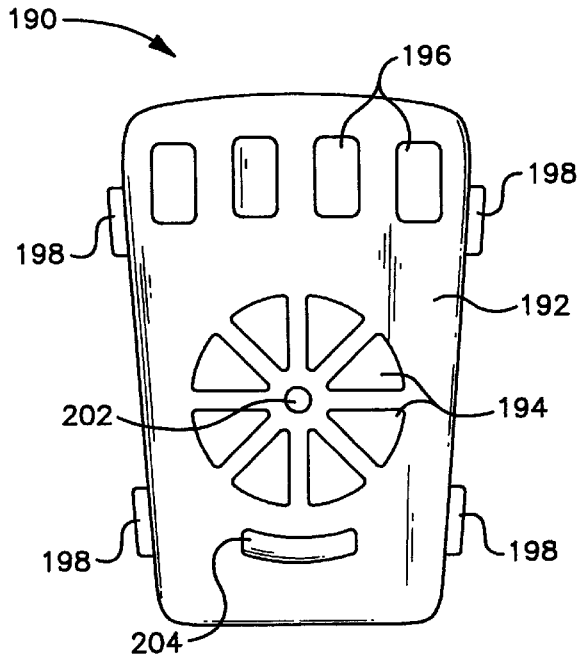
FIG. 13*a* a plan view of another joystick input device of the present system.
Figure 13B:
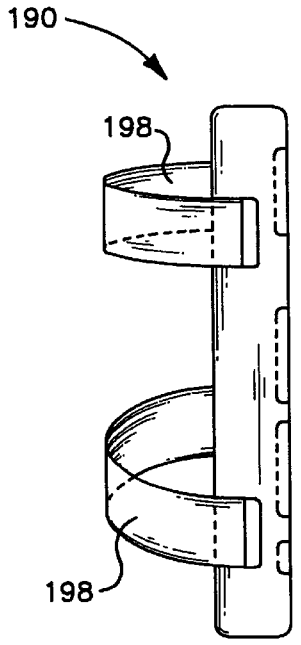
FIG. 13*b* is a front elevation of the device of FIG. 13*a;*

FIGS. 13*a* and 13*b* illustrate another joystick 190 according to the present invention. The joystick 190 includes a base or body 192 which is provided with eight direction buttons 194 and a plurality of control buttons 196, and one or more backstraps 198 made of velcro or the like for attaching the joystick 190 to a user's left or right hand. The direction buttons 194 are arranged in a radial pattern.

The user inserts the left hand into a space between the body 192 and backstraps 198 with the palm facing out of the plane of the drawing in FIG. 13*a*, and leftwardly as viewed in FIG. 13*b*, with the fingers pointing upwardly as viewed in both drawings. This enables the user to operate the buttons 196 with the fingers of the left hand, and the buttons 194 with the fingers of the right hand. Further illustrated are alternative locations 200 and 202 for shift buttons.

Figure 14A:
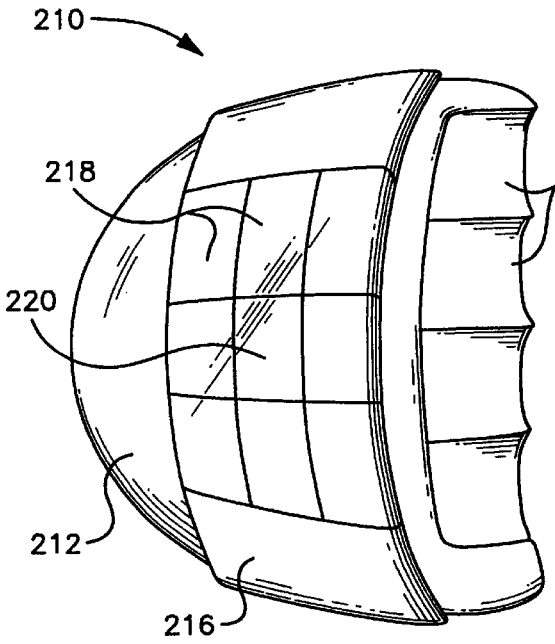
FIG. 14*a* a plan view of another joystick input device of the present system.
Figure 14B:
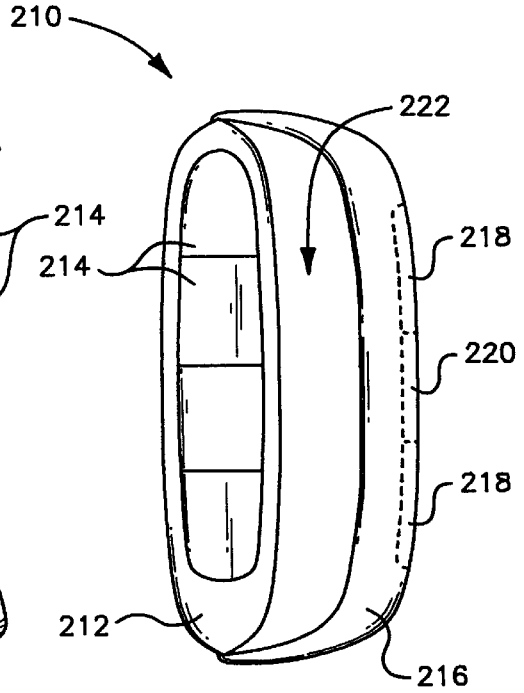
FIG. 14*b* is a front elevation of the device of FIG. 14*a;*

FIGS. 14*a* and 14*b* illustrate another joystick 210 embodying the present invention which includes a body 212 provided with control buttons 214 in the form of finger grips as described above with reference to FIG. 12*a*. A backstrap 216 is provided for attaching the joystick 210 to a user's left hand. The backstrap 216 is provided with direction buttons 218 arranged in a rectangular pattern, and a central shift button 220.

The user inserts the left hand into a space 222 between the body 212 and backstrap 216, with the palm facing into the plane of the drawing and the fingers pointing rightwardly as viewed in FIG. 14*a*. The palm faces leftwardly and the fingers point out of the plane of the drawing as viewed in FIG. 14*b*.

In this manner, the user operates the control buttons 214 with the fingers of the left hand, and "plays the back of his left hand" using the fingers of the right hand to depress the direction buttons 218 and shift button 220. This configuration is possible because the direction buttons and shift button 220 extend away from the back of the left hand.

Although the shift button 220 is illustrated in the drawings as being in the center of the set of direction buttons 218, the invention is not so limited, and the shift button can be provided at any other desired location, such as the bottom of the body 212 (the left side as viewed in FIG. 14*b*.

Figures 15A, 15B:
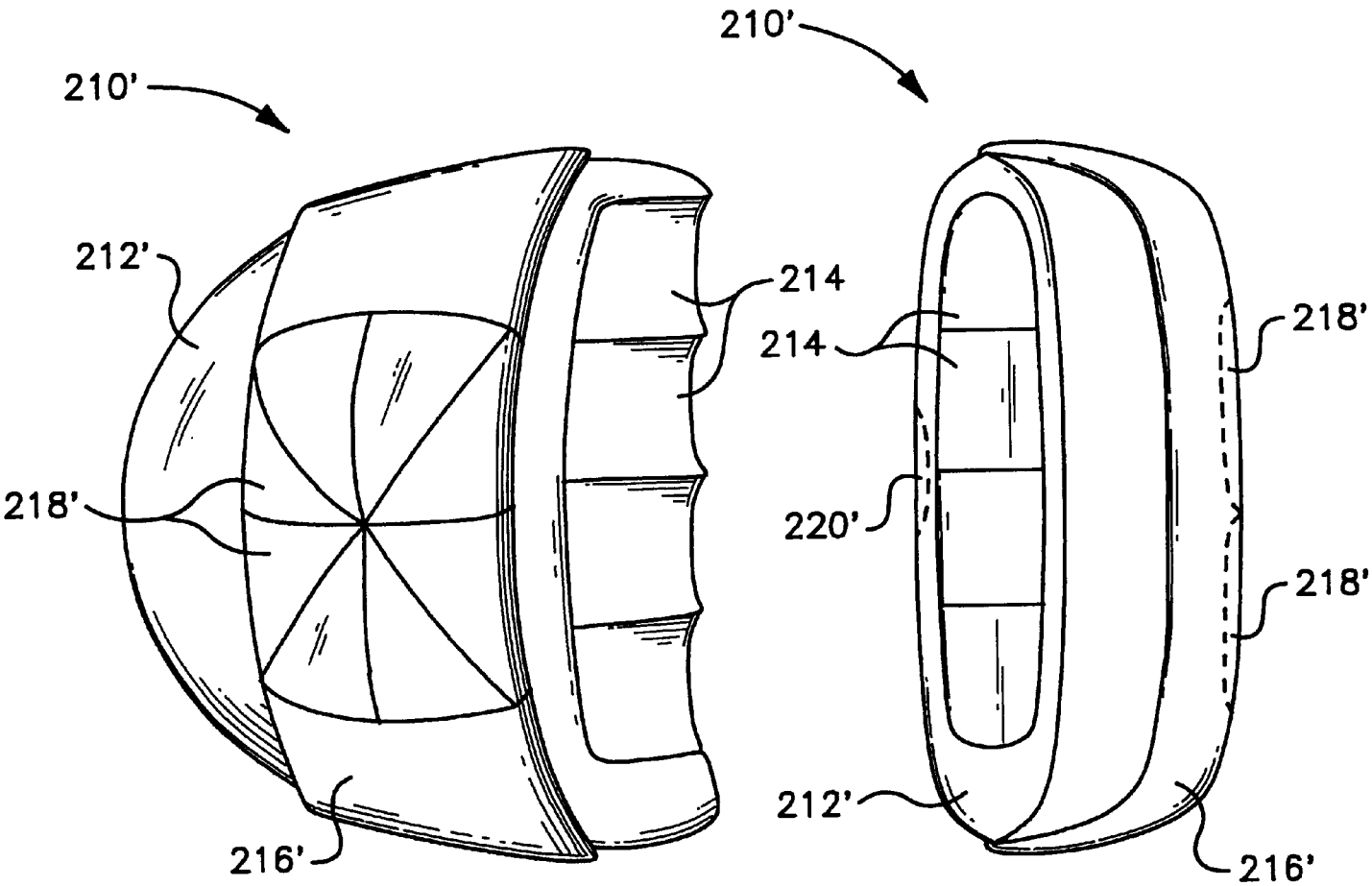
FIG. 15*a* a plan view of another joystick input device of the present system.
FIG. 15*b* is a front elevation of the device of FIG. 14*a*.

FIGS. 15*a* and 15*b* illustrate yet another joystick 210' embodying the present invention, in which like parts are designated by the same reference numerals used in FIGS. 14*a* and 14*b*, and corresponding but modified elements are designated by the same reference numerals primed.

The joystick 210' differs from the joystick 210 in that the direction buttons 218' are arranged in a radial pattern rather than a rectangular pattern. In FIG. 15*b*, the shift button 220' is explicitly illustrated as being provided on the bottom of the body 212'.

Various modifications will become possible for those skilled in the art after receiving the teachings of the present disclosure without departing from the scope thereof. For example, any of the joystick embodiments of the invention can be provided in left-handed models, as alternatives to the right-handed models as described and illustrated. As another modification, any of the embodiments described above can be implemented using eight, or some other number, of buttons rather than a mechanical joystick mechanism.

I claim:

1. A system for playing predefined musical sequences, comprising:

display means having visual icons corresponding to said sequences respectively;

input means for interactively selecting and de-selecting icons;

player means for playing selected sequences corresponding to said selected icons simultaneously, and controlling the display means such that said icons distinguish said selected sequences from de-selected sequences; and synchronizer means for musically synchronizing said selected sequences;

in which the input means includes:

a body which is ergonomically conjugate to a human hand; and actuator means extending from the body for mechanically inputting a plurality of discrete direction indications corresponding to said icons respectively.

2. A system as in claim 1, in which the actuator means comprises a joystick handle.

3. A system as in claim 1, in which the actuator means comprises a plurality of buttons which are oriented to correspond to said direction indications respectively.

4. A system as in claim 3, in which said buttons are illuminatable to indicate different status conditions.

5. A system as in claim 3, in which said buttons are arranged in a rectangular pattern.

6. A system as in claim 3, in which said buttons are arranged in a radial pattern.

7. A system as in claim 1, in which the body comprises a backstrap.

8. A system as in claim 7, in which said buttons extend from the backstrap.

9. A system as in claim 8, in which:

the body comprises a base from which the backstrap extends; and the input means further comprises a plurality of buttons extending from the base that are shaped as finger grips.

10. A system as in claim 1, further comprising a plurality of buttons that extend from the body and are shaped as finger grips.

* * * * *